US008834048B2

(12) United States Patent
Mochida et al.

(10) Patent No.: US 8,834,048 B2
(45) Date of Patent: Sep. 16, 2014

(54) PRINTER WITH CUTTER HAVING BLADE INCLUDING LINERLESS LABEL SUPPORTING PORTION

(75) Inventors: Sadayoshi Mochida, Shizuoka (JP); Tsuyoshi Sanada, Singapore (SG)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 203 days.

(21) Appl. No.: 13/158,560

(22) Filed: Jun. 13, 2011

(65) Prior Publication Data

US 2012/0027495 A1 Feb. 2, 2012

(30) Foreign Application Priority Data

Jul. 29, 2010 (JP) ..... 2010-170914

(51) Int. Cl.
*B41J 11/70* (2006.01)
*B26D 1/08* (2006.01)

(52) U.S. Cl.
CPC ..... *B41J 11/703* (2013.01); *Y10S 83/922* (2013.01)
USPC ..... 400/621; 83/694; 83/922

(58) Field of Classification Search
CPC ..... B41J 11/703; B26D 1/085
USPC ..... 400/621; 225/25, 26; 83/694, 922
See application file for complete search history.

(56) References Cited

U.S. PATENT DOCUMENTS 4,742,742 A * 5/1988 Yokoe ..... 83/101
5,235,887 A * 8/1993 Moriya ..... 83/282
5,259,681 A * 11/1993 Kitazawa et al. ..... 400/621
5,725,320 A * 3/1998 Austin et al. ..... 400/642
6,113,294 A * 9/2000 Niwa ..... 400/621
6,151,055 A * 11/2000 Ackley et al. ..... 347/215
6,357,941 B1 * 3/2002 Amano et al. ..... 60/761
6,688,198 B2 * 2/2004 Matsumoto et al. ..... 83/139
7,186,043 B2 * 3/2007 Keller ..... 400/619
7,540,222 B2 * 6/2009 Kim ..... 83/84
8,562,229 B2 * 10/2013 Inaba et al.
2007/0028739 A1 * 2/2007 Kawaguchi ..... 83/651
2009/0028623 A1 * 1/2009 Yokoyama ..... 400/613

FOREIGN PATENT DOCUMENTS

EP 1566248 A1 * 8/2005 ..... B26D 1/08
JP 04099669 A * 3/1992 ..... B41J 11/66
JP 08207176 A * 8/1996 ..... B31D 1/02
JP 2000-062264 2/2000

(Continued)

OTHER PUBLICATIONS

Japanese Office Action for Japanese Application No. 2010-170914 mailed on May 8, 2012.

*Primary Examiner* — Daniel J Colilla
(74) *Attorney, Agent, or Firm* — Amin, Turocy & Watson, LLP

(57) ABSTRACT

A cutter unit includes a conveying mechanism, a first blade and a second blade. The conveying mechanism conveys a linerless label having an adhesive-applied surface on which an adhesive agent is applied. The first blade is provided to face an opposite side from the adhesive-applied surface of the linerless label. The second blade is provided to face the adhesive-applied surface of the linerless label. The second blade includes a cutting portion configured to cut the linerless label inserted between the second blade and the first blade, and a supporting portion configured to support the adhesive-applied surface of the linerless label downstream of the cutting portion in a conveying direction of the linerless label.

11 Claims, 5 Drawing Sheets

(56) References Cited

FOREIGN PATENT DOCUMENTS

| | | | | | | |
|---|---|---|---|---|---|---|
| JP | 2000-190280 | | | 11/2000 | | |
| JP | 2001-206621 | | | 7/2001 | | |
| JP | 2004-148442 | | | 5/2004 | | |
| JP | 2006205309 | A | * | 8/2006 | ..... | B26D 1/08 |
| JP | 2007044837 | A | * | 2/2007 | ..... | B26D 1/08 |

* cited by examiner

PRINTER WITH CUTTER HAVING BLADE INCLUDING LINERLESS LABEL SUPPORTING PORTION

CROSS-REFERENCE TO RELATED APPLICATIONS

This application is based upon and claims the benefit of priority from Japanese Patent Application No. 2010-170914, filed on Jul. 29, 2010, the entire contents of which are incorporated herein by reference.

FIELD

Embodiments described herein relate generally to a cutter unit and a printer.

BACKGROUND

In the related art, a label printer includes a cutter unit to cut printed paper without a backing sheet, such as a linerless label. The printed paper is cut to a predetermined length and the label printer issues the printed paper cut by the cutting unit as a label. The label issued from the label printer may be taken out by an operator or an automatic label attachment apparatus and then attached to a packaged article, a machine or the like.

Such a label printer further includes a sensor, which is located downstream of the cutter unit in a label conveying direction, to detect whether the label cut by the cutter unit is taken out by the operator or the automatic label attachment apparatus. When it is detected by the sensor that the label is taken out, the label printer cuts the next label with the cutter unit and issues the next label from a label dispensing outlet, which again may be taken out by the operator and the automatic label attachment apparatus.

However, if the middle part of a label issued from such a conventional label printer is very flexible since the label has no backing sheet, the label cut by the cutter unit may be loosened from a label conveying path between the cutter unit and the label dispensing outlet or may be dropped due to its own weight before it is taken out by the operator or the automatic label attachment apparatus. In this case, the operator or the automatic label attachment apparatus may have difficulty taking out the issued label.

DETAILED DESCRIPTION

According to one embodiment, a cutter unit includes a conveying mechanism configured to convey a linerless label having an adhesive-applied surface on which an adhesive agent is applied. The cutter unit also includes a first blade provided to face an opposite side from the adhesive-applied surface of the linerless label. The cutter unit further includes a second blade provided to face the adhesive-applied surface of the linerless label. The second blade includes a cutting portion configured to cut the linerless label inserted between the second blade and the first blade, and a supporting portion configured to support the adhesive-applied surface of the linerless label downstream of the cutting portion in a conveying direction of the linerless label.

Embodiments will now be described in detail with reference to the drawings.

Figure 1:
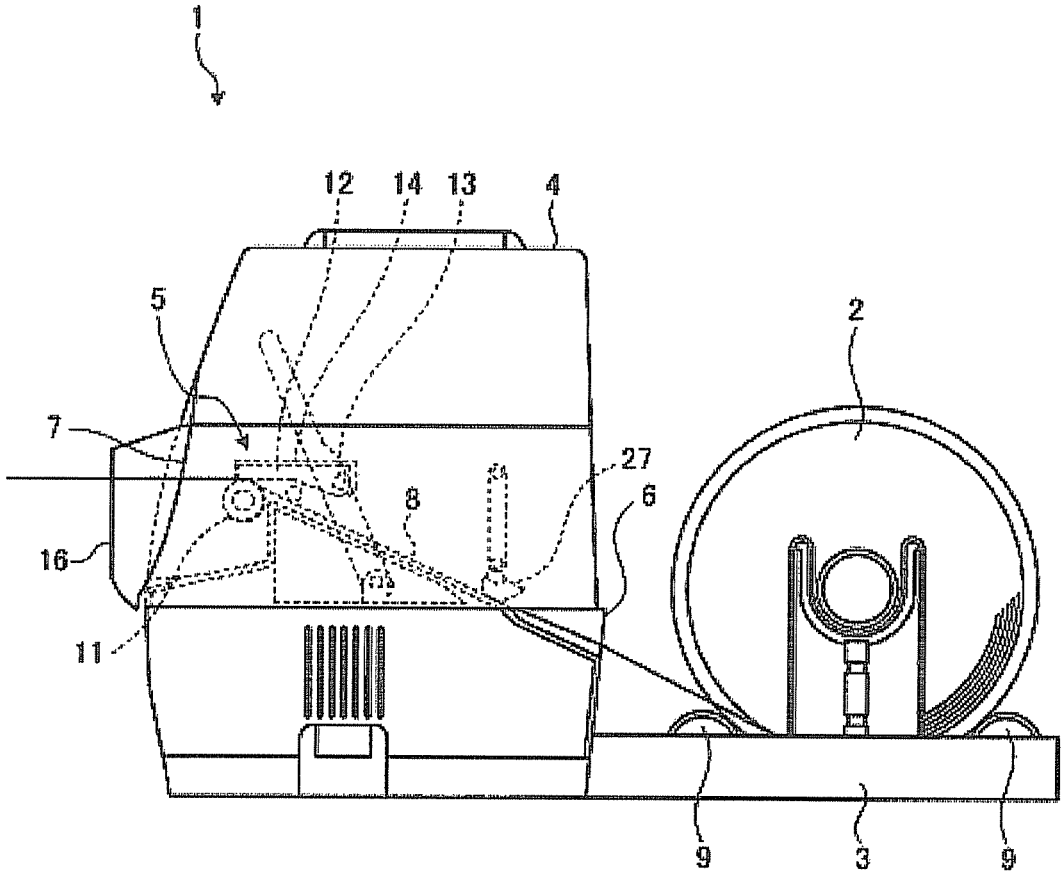
FIG. 1 is a schematic side sectional view showing a label printer according to a first embodiment.

FIG. 1 is a schematic side sectional view showing a label printer according to a first embodiment. A label printer 1 includes a paper holding part 3 which is disposed outside a housing 4 to hold a continuous paper 2. The label printer 1 introduces (draws) the continuous paper 2 held in the paper holding part 3 into the housing 4. Then, the label printer 1 prints predetermined information on the introduced continuous paper 2 by means of a printing mechanism 5 accommodated in the housing 4. In one embodiment, the continuous paper 2 may be a linerless label, which has an adhesive-applied surface 2*a* (see FIG. 4, etc.) on which an adhesive agent is applied, without a backing sheet to which the adhesive-applied surface 2*a* is attached. In this embodiment, an example of the continuous paper 2 may include a label paper or a tag paper in the form of a rolled paper.

A conveying path 8 extending from a paper feed opening 6 to a paper discharge opening 7 is formed within the housing 4. The continuous paper 2 is supported by a pair of rotatable paper holding rollers 9 in the paper holding part 3. The continuous paper 2 supported by the paper holding rollers 9 is introduced from the paper feed opening 6 into the conveying path 8 and then is guided to be discharged from the paper discharge opening 7.

The printing mechanism 5 is provided on the conveying path 8 along which the continuous paper 2 is conveyed. The printing mechanism 5 includes a platen roller 11 serving as a conveying mechanism, which is rotated by a stepping motor 57 (see FIG. 5) to convey the continuous paper 2 introduced into the housing 4, and a line thermal head 12 opposing the platen roller 11 with the conveying path 8 interposed therebetween. The line thermal head 12 is held on a head holding plate 14, which is rotatably supported by a support shaft 13 provided in parallel to the platen roller 11. The head holding plate 14 may be pressed by means of a spring (not shown) so that the line thermal head 12 is biased against the platen roller 11. In addition, a cutter unit 16 is provided in the vicinity of the paper discharge opening 7.

In this embodiment, to issue the continuous paper 2 for which printing is completed by the printing mechanism 5, the label printer 1 may select one of two types of issuance operations. In one of the two operations, a label is issued by cutting a backing sheet for each label using the cutter unit 16. In the other type of operation, a label is issued by cutting the continuous paper 2 to a predetermined length using the cutter unit 16.

In addition, in this embodiment, the label printer 1 employs a line type printing method. The line thermal head 12 has a plurality of heating elements (not shown) arranged in a line and performs a printing operation in a main scan direction using the plurality of heating elements. The line thermal head 12 performs a printing operation in a sub scan direction by the movement of the continuous paper 2 with respect to the line thermal head 12, which is caused by conveyance of the continuous paper 2. Thus, detection of a conveyance timing of the continuous paper 2 is required for the printing operation in the sub scan direction. For the detection of the conveyance timing, in this embodiment, a sensor unit 27 including two sensors such as a transmission type sensor and a reflection type sensor is provided on the conveying path 8.

Figure 2:
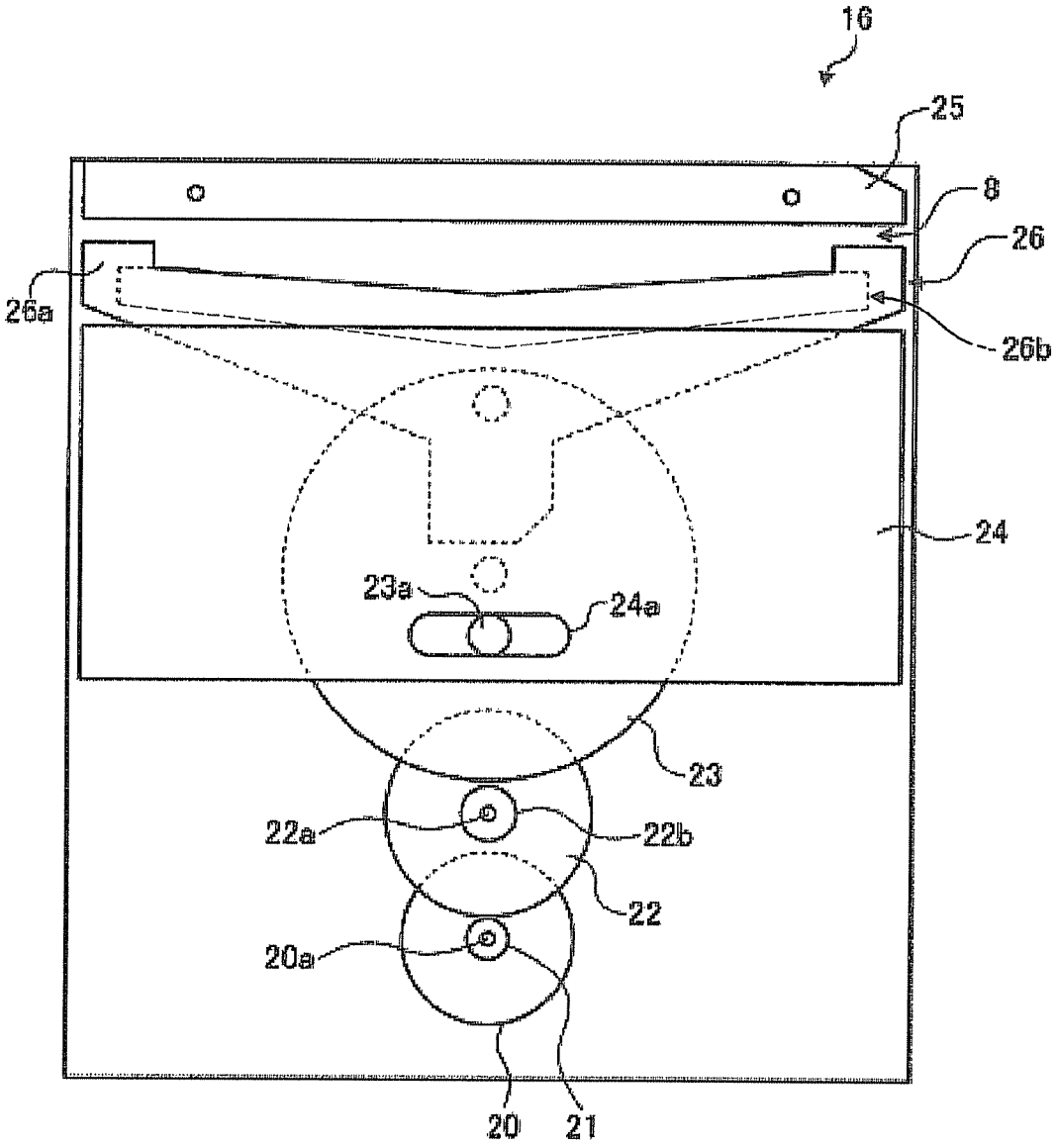
FIG. 2 is a front view showing an illustrative embodiment of a cutter unit in the label printer.

FIG. 2 is a front view showing an illustrative embodiment of the cutter unit in the label printer. The cutter unit 16 is also called a "guillotine cutter" and includes a motor 20, a driven gear 22, a rolling body 23, a movable blade holding member 24, a fixed blade 25 and a movable blade 26.

The motor 20 may rotate to provide a driving force to the movable blade 26. The motor 20 includes a driving gear 21 which is provided at a leading end portion of a shaft 20*a* of the motor 20 and transfers a driving force to the movable blade 26.

The driven gear 22 is driven to be rotated in engagement with the driving gear 21 at one end of an edge portion. The driven gear 22 includes a driving gear 22*b* which is provided at a leading end portion of a shaft 22*a* of the driven gear 22 and transfers a driving force to the rolling body 23.

The rolling body 23 is driven to be rotated in engagement with the driving gear 22*b* of the driven gear 22. The rolling body 23 includes a fixing pin 23*a* provided at a position eccentric from the center of the rolling body 23. The position of the fixing pin 23*a* may be changed when the rolling body 23 rotates.

The movable blade holding member 24 holds the movable blade 26 in an upper side of the cutter unit 16. The movable blade holding member 24 includes a cam groove 24*a* in which the fixing pin 23*a* of the rolling body 23 is inserted. With this configuration, the movable blade holding member 24 may be moved to the upper or lower side of the cutter unit 16 depending on the change in position of the fixing pin 23*a* of the rolling body 23.

The fixed blade 25 (serving as a "first blade") is provided to face a print surface 2*b* opposite the adhesive-applied surface 2*a* of the continuous paper 2 (i.e., in the upper side of the cutter unit 16) and is arranged to traverse the continuous paper 2 printed with predetermined information by the printing mechanism 5. That is, the fixed blade 25 is disposed above the conveying path 8 and is fixed in the cutter unit 16 by a fastening member (not shown). On the other hand, the movable blade 26 (serving as a "second blade") is provided to face the adhesive-applied surface 2*a* of the continuous paper 2. The movable blade 26 is configured to cut the continuous paper 2 interposed between the movable blade 26 and the fixed blade 25 when the movable blade 26 is moved toward the upper side of the cutter unit 16 as the movable blade holding member 24 is moved. That is, the movable blade 26 is disposed below the conveying path 8 and cuts the continuous paper 2 interposed between the movable blade 26 and the fixed blade 25 when the movable blade 26 is moved to the upper side of the cutter unit 16 as the movable blade holding member 24 is moved.

Figure 3:
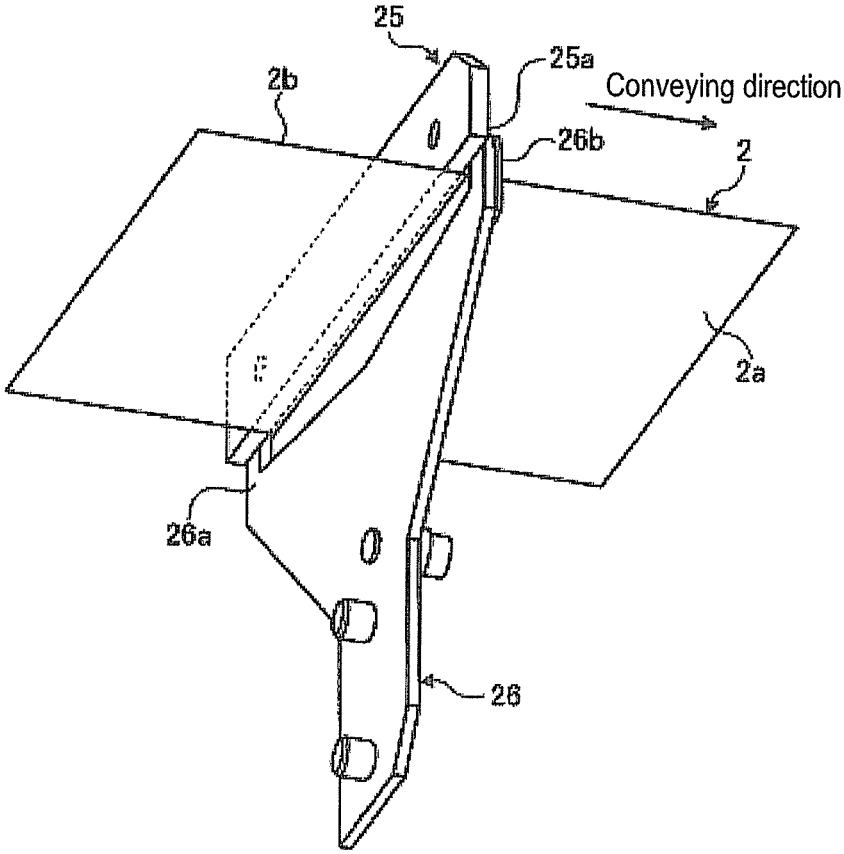
FIG. 3 is a perspective view showing a configuration of a fixed blade and a movable blade.
Figure 4:
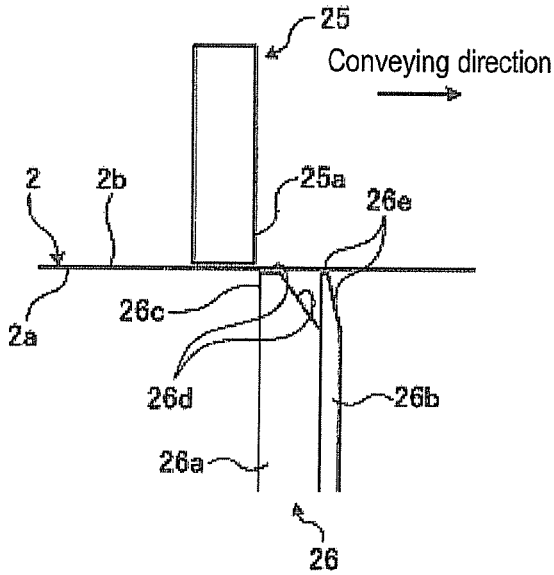
FIG. 4 is a side view showing a configuration of the fixed blade and the movable blade.

A configuration of the fixed blade 25 and the movable blade 26 will be described in detail with reference to FIGS. 3 and 4. FIG. 3 is a perspective view showing a configuration of the fixed blade and the movable blade. FIG. 4 is a side view showing a configuration of the fixed blade and the movable blade.

The fixed blade 25 includes a cutting surface 25*a* configured to cut the continuous paper 2 inserted between the fixed blade 25 and the movable blade 26.

The movable blade 26 includes a cutting portion 26*a* configured to cut the continuous paper 2 inserted between the movable blade 26 and the fixed blade 25 when the movable blade 26 is moved toward the upper side of the cutter unit 16. The movable blade 26 further includes a supporting portion 26*b* configured to support the adhesive-applied surface 2*a* of the cut continuous paper 2 downstream of the cutting portion 26*a* in the conveying direction of the continuous paper 2 in order to prevent the cut continuous paper 2 from straying out of the conveying path 8. This allows the continuous paper 2 cut by the fixed blade 25 and the movable blade 26 to be kept on the conveying path 8, and thus an operator or an automatic label attachment device may take out the continuous paper 2 easily.

More specifically, the cutting portion 26*a* includes a cutting surface 26*c* configured to cut the continuous paper 2 inserted between the cutting surface 26*c* and the cutting surface 25*a* of the fixed blade 25 by sliding cutting surface 26*c* on the cutting surface 25*a*. Further, the cutting portion 26*a* includes a contact surface 26*d* configured to contact the adhesive-applied surface 2*a* of the continuous paper 2 cut by the cutting surface 26*c*.

The contact surface 26*d* is inclined to gradually be further from the conveying path 8 as the contact surface 26*d* is directed downstream of the conveying direction of the continuous paper 2. This allows a contact area of the movable blade 26 with the adhesive-applied surface 2*a* of the continuous paper 2 to be reduced, which may prevent jamming of the continuous paper 2 due to the adhesion of the adhesive-applied surface 2*a* of the continuous paper 2 to the movable blade 26.

Although it is illustrated in this embodiment that the contact surface 26*d* is inclined to gradually be further from the conveying path 8 as the contact surface 26*d* is directed downstream of the conveying direction of the continuous paper 2, the embodiment is not limited thereto as long as the supporting portion 26*b* is disposed at a position apart from the cutting portion 26*a* downstream of the conveying direction of the continuous paper 2 so that a space is formed between the cutting portion 26*a* and the supporting portion 26*b*. For example, the contact surface 26*d* of the cutting portion 26*a* may have a concave step, facing the adhesive-applied surface 2*a* of the continuous paper 2, formed between the cutting portion 26*a* and the supporting portion 26*b*.

The supporting portion 26*b* includes a supporting surface 26*e* to support the adhesive-applied surface 2*a* of the continuous paper 2 downstream of the contact surface 26*d* of the cutting portion 26*a* in the conveying direction of the continuous paper 2*a*. The supporting surface 26*e* is inclined to gradually be further from the conveying path 8 as the supporting surface 26*e* is directed downstream of the conveying direction of the continuous paper 2. This allows a contact area of the supporting surface 26*e* with the adhesive-applied surface 2*a* of the continuous paper 2 to be reduced, and may prevent jamming of the continuous paper 2 due to the adhesion of the adhesive-applied surface 2*a* of the continuous paper 2 to the supporting surface 26*e*.

In this embodiment, it is assumed that the cutting portion 26*a* and the supporting portion 26*b* are all coated with an adhesion-retardant agent such as Teflon® or a paper anti-attachment paint, except the cutting surface 26*c*. An example of a paper anti-attachment paint may include BYCOAT® (available from Yoshida SKT, Co., Ltd.), PAPYLESS® (available from Natoco Paints, Co., Ltd.), DEFRIC® (available from Gawayuu Research, Co., Ltd.), etc.

Figure 5:
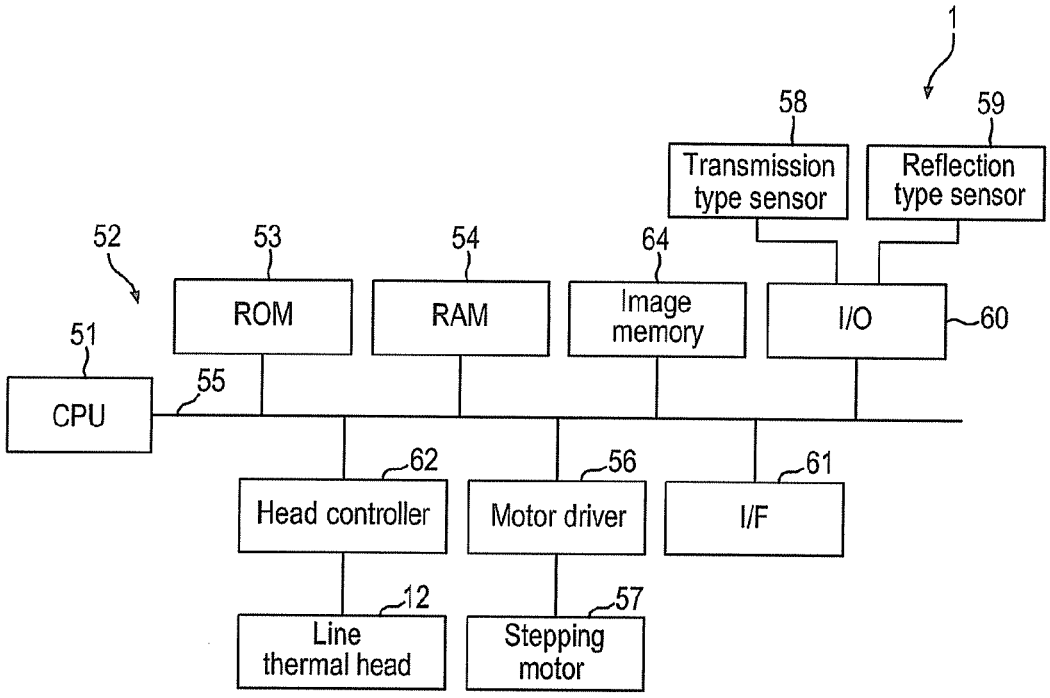
FIG. 5 is a block diagram showing electrical connections of respective components of the label printer.

FIG. 5 is a block diagram showing electrical connections of respective components of the label printer. The label printer 1 drives respective components such as the stepping motor 57 (to rotate the platen roller 11), the line thermal head 13 and so on under control of a microcomputer 52 including a central processing unit (CPU) 51 and so on. Specifically, the label printer 1 includes the CPU 51 to centrally control the respective components by executing various arithmetic processes. The CPU 51 is connected, via a system bus 55, to a read only memory (ROM) 53 configured to store static data, and a random access memory (RAM) 54 configured to store variable data in a rewritable manner. The ROM 53 stores a control program and the microcomputer 52 executes various processes using the RAM 54 as a work area according to the control program stored in the ROM 53.

In this embodiment, the label printer 1 further includes some components that are driven and controlled by the microcomputer 52 to perform a printing operation in the printing mechanism 5. Specifically, the label printer 1 includes a motor driver 56 to drive the stepping motor 57 (which rotates the platen roller 11) and the motor 20, and a head controller 62 which is a print control unit to control the line thermal head 12. The motor driver 56 and head controller 62 are connected to the CPU 51 via the system bus 55.

Specifically, when it is detected that the continuous paper 2 cut by the cutter unit 16 is taken out from the conveying path 8, the motor driver 56 rotates the stepping motor 57, which then rotates the platen roller 11 to convey the continuous paper 2. In addition, the motor driver 56 rotates the motor 20 to transfer a driving force from the motor 20 to the driven gear 22, the rolling body 23 and the movable blade holding member 24 successively. The motor driver 56 moves the movable blade 26 held by the movable blade holding member 24 toward the upper side of the conveying path 8 (i.e., toward the upper side of the cutter unit 16), so that the movable blade 26 may cut the continuous paper 2 inserted between the fixed blade 25 and the movable blade 26.

In this embodiment, the label printer 1 resumes to convey the continuous paper 2 when the continuous paper 2 cut by the cutter unit 16 is taken out by an operator or an automatic attachment device. Therefore, the label printer 1 needs to detect that the continuous paper 2 cut by the cutter unit 16 is taken out. Accordingly, the label printer 1 includes a transmission type sensor 58 located downstream of the fixed blade 25 and the movable blade 26 of the cutter unit 16 in the conveying direction of the continuous paper 26 in order to detect whether the continuous paper 2 is taken out.

In addition, in this embodiment, since the label printer 1 employs a line type printing method, the line thermal head 12 performs a printing operation in a main scan direction by means of a plurality of heating elements arranged in a line. The label printer 1 performs a printing operation in a sub scan direction by the movement of the continuous paper with respect to the line thermal head 12, which is caused by the conveyance of the continuous paper 2. Thus, the label printer 1 requires detection of a conveyance timing of the continuous paper 2 for the printing operation in the sub scan direction. To this end, the label printer 1 includes a reflection type sensor 59 provided on the conveying path 8 for detection of the conveyance timing of the continuous paper 2.

These transmission type sensor 58 and reflection type sensor 59 are connected to the system bus 55 via an I/O port 60. In this embodiment, the transmission type sensor 58 is a sensor configured to detect whether or not the continuous paper 2 cut by the cutter unit 16 remains on the conveying path 8, while the reflection type sensor 59 is a sensor configured to detect a position detection mark printed on the continuous paper 2.

In addition, in this embodiment, the label printer 1 receives, via an interface 61, print data transferred from an external device, converts the print data received via the interface 61 into image data, and deploys the image data on an image memory 63. Further, the CPU 51 outputs each line of data based on the image data converted from the received print data. To this end, the interface 61 and the image memory 63 are also connected to the CPU 51 via the system bus 55.

In addition, a thermistor and an AD converter (not shown) may be attached to a head substrate (not shown) of the line thermal head 12. In this configuration, a detection signal output from the thermistor is converted into a digital value by means of the AD converter, which is then provided to the CPU 51.

According to the first embodiment as described above, the label printer 1 includes the fixed blade 25 provided to face the printed surface 2*b* side of the continuous paper 2, and the movable blade 26 provided to face the adhesive-applied surface 2*a* side of the continuous paper 2. The movable blade 26 includes the cutting portion 26*a* configured to cut the continuous paper 2 inserted between the movable blade 26 and the fixed blade 25, and the supporting portion 26*b* configured to support the adhesive-applied surface 2*a* of the cut continuous paper 2 downstream of the cutting portion 26*a* in the conveying direction of the continuous paper 2, thereby preventing the cut continuous paper 2 from straying out of the conveying path 8. Accordingly, the continuous paper 2 cut by the fixed blade 25 and the movable blade 26 may be kept on the conveying path 8 of the continuous paper 2, and thus an operator or an automatic label attachment device is able to take out the continuous paper 2 easily.

In another embodiment, the leading end portion of the supporting surface of the supporting portion of the movable blade may include recess portions (or grooves) facing the conveying path. This configuration will be described in more detail, where description of the same portions as the first embodiment will be omitted and only portions different from the first embodiment will be described.

Figure 6:
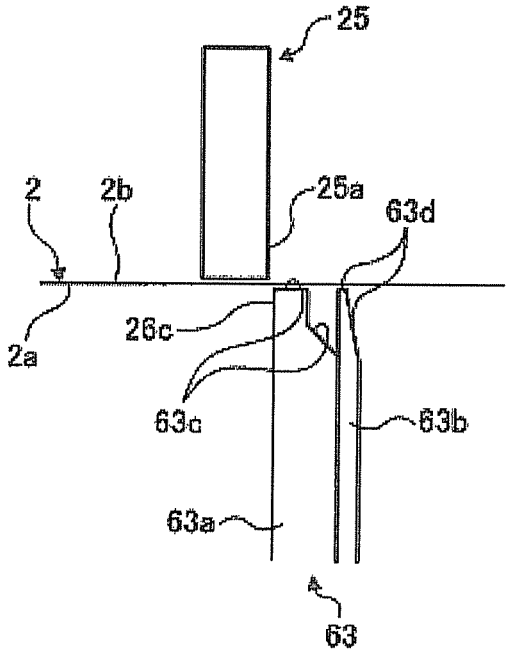
FIG. 6 is a side view showing a configuration of a fixed blade and a movable blade.
Figure 7:
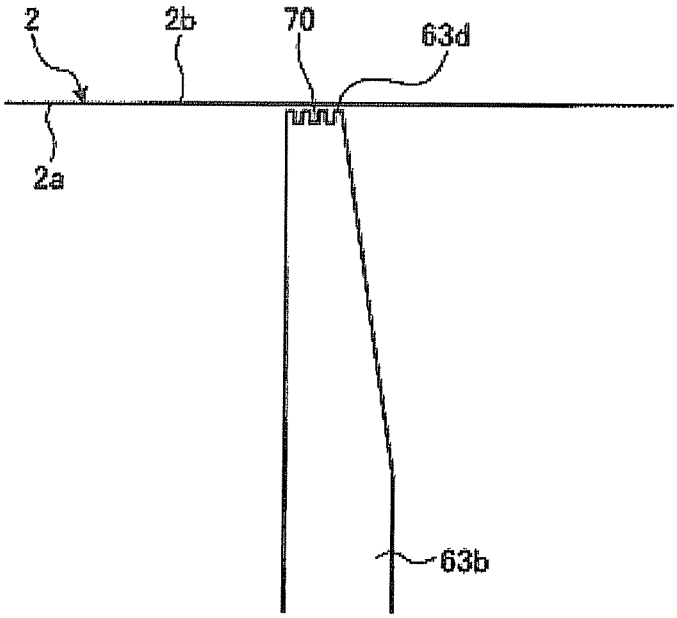
FIG. 7 is an enlarged view of a supporting portion of the movable blade.

FIG. 6 is a side view showing a configuration of the fixed blade and the movable blade according to a second embodiment. FIG. 7 is an enlarged view of the supporting portion of the movable blade. In this embodiment, the movable blade 63 includes a concave step on the side facing the conveying path, which is formed between a contact surface 63*c* contacting the adhesive-applied surface 2*a* of the continuous paper 2 and a supporting portion 63*b*.

In addition, in this embodiment, the supporting portion 63*b* of a movable blade 63 includes a supporting surface 63*d* configured to support the adhesive-applied surface 2*a* of the continuous paper 2 downstream of the contact surface 63*c* in the conveying direction of the continuous paper 2. The supporting surface 63*d* of the supporting portion 63*b* has recess portions (or grooves) 70 facing the conveying path 8. The recess portions 70 may reduce a contact area between the supporting portion 63*b* and the adhesive-applied surface 2*a* of the continuous paper 2 which is cut by the cutter unit 16 and remains on the conveying path 8, which may prevent the jamming of the continuous paper 2 due to the adhesion of the continuous paper 2 to the supporting portion 63*b*. The recess portions 70 of the supporting surface 63*d* are not limited to such shapes as shown in FIG. 7 on the opposite side to the conveying path 8. For example, a plurality of bumps may be formed in the supporting surface 63*d* to decrease a contact area between the adhesive-applied surface 2*a* of the continuous paper 2 and the supporting surface 63*d*.

As described above, in the label printer 1 according to the second embodiment, the supporting portion 63*b* of the movable blade 63 includes the supporting surface 63*d* configured to support the adhesive-applied surface 2*a* of the continuous paper 2 on which an adhesive agent is applied. The supporting surface includes the recess portions 70 facing the conveying path 8, thereby reducing the contact area between the supporting portion 63*b* and the adhesive-applied surface 2*a* of the continuous paper 2 which is cut by the cutter unit 16 and remains on the conveying path 8, which may prevent the jamming of the continuous paper 2 due to the adhesion of the continuous paper 2 to the supporting portion 63*b*.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A cutter unit applicable to a printer including a conveying mechanism to convey a linerless label having an adhesive-applied surface on which an adhesive agent is applied along a conveying path, the cutter unit comprising:

a first fixed blade provided above the conveying path to face an opposite side from the adhesive-applied surface of the linerless label; and a second movable blade provided below the conveying path downstream from the first fixed blade in a conveying direction of the linerless label to face the adhesive-applied surface of the linerless label, the second movable blade including a cutting portion configured to cut the linerless label inserted between the second movable blade and the first fixed blade when the second movable blade is moved toward an upper side of the conveying path, and a supporting portion configured to support the adhesive-applied surface of the linerless label downstream of the cutting portion in the conveying direction, wherein the supporting portion is located apart from the cutting portion downstream in the conveying direction, with a space formed between the cutting portion and the supporting portion, wherein the cutting portion includes a contact surface configured to contact the adhesive-applied surface of the cut linerless label, and wherein the supporting portion includes a supporting surface configured to support the adhesive-applied surface of the cut linerless label, the supporting surface being inclined to gradually be further from the conveying path in the conveying direction of the linerless label.

2. The cutter unit of claim 1, wherein the supporting portion is coated with an adhesion-retardant agent.

3. The cutter unit of claim 1, wherein the supporting surface includes a recess portion.

4. A printer comprising:

a conveying mechanism configured to convey a linerless label having an adhesive-applied surface on which an adhesive agent is applied;

a printing mechanism provided on a conveying path along which the linerless label is conveyed;

a first fixed blade provided above the conveying path and downstream of the printing mechanism to face an opposite side from the adhesive-applied surface of the linerless label; and a second movable blade provided below the conveying path downstream from the first fixed blade in a conveying direction of the linerless label to face the adhesive-applied surface of the linerless label, the second movable blade including a cutting portion configured to cut the linerless label inserted between the second movable blade and the first fixed blade when the second movable blade is moved toward an upper side of the conveying path, and a supporting portion configured to support the adhesive-applied surface of the linerless label downstream of the cutting portion in the conveying direction, wherein the supporting portion is located apart from the cutting portion downstream in the conveying direction, with a space formed between the cutting portion and the supporting portion, wherein the cutting portion includes a contact surface configured to contact the adhesive-applied surface of the cut linerless label, and wherein the supporting portion includes a supporting surface configured to support the adhesive-applied surface of the cut linerless label, the supporting surface being inclined to gradually be further from the conveying path in the conveying direction of the linerless label.

5. The printer unit of claim 4, wherein the supporting portion is coated with an adhesion-retardant agent.

6. The printer of claim 4, wherein the supporting surface includes a recess portion.

7. A printer comprising:

a conveyer configured to convey a linerless label having an adhesive-applied surface on which an adhesive agent is applied and a print surface on which predetermined information is printed along a conveying path;

a printing mechanism configured to print an image on the print surface;

a first fixed blade provided above the conveying path to face the print surface of the linerless label; and a second movable blade provided below the conveying path downstream from the first fixed blade in a conveying direction of the linerless label to face the adhesive-applied surface of the linerless label, the second movable blade including a cutting portion configured to cut the linerless label inserted between the second movable blade and the first fixed blade when the second movable blade is moved toward an upper side of the conveying path, and a supporting portion configured to support the adhesive-applied surface of the linerless label downstream of the cutting portion in the conveying direction, wherein the supporting portion is disposed apart from the cutting portion downstream of the cutting portion in the conveying direction, with a space formed between the cutting portion and the supporting portion, wherein the cutting portion includes a contact surface configured to contact the adhesive-applied surface of the cut linerless label, and wherein the supporting portion includes a supporting surface configured to support the adhesive-applied surface of the cut linerless label, the supporting surface being inclined to gradually be further from the conveying path in the conveying direction of the linerless label.

8. The printer of claim 7, wherein the supporting portion is coated with an adhesion-retardant agent.

9. The printer of claim 7, wherein the supporting surface includes at least one recess portion.

10. The printer of claim 7, wherein the supporting surface includes at least one groove.

11. The printer of claim 7, wherein the supporting surface including at least one bump.

* * * * *